US005119567A

United States Patent [19]

Fox

[11] Patent Number: 5,119,567

[45] Date of Patent: Jun. 9, 1992

[54] GLASS BLOCK SPACING TOOL AND METHOD

[75] Inventor: Robert E. Fox, Clawson, Mich.

[73] Assignee: Trend Products, Inc., Warren, Mich.

[21] Appl. No.: 561,195

[22] Filed: Aug. 1, 1990

[51] Int. Cl.[5] ..... G01B 3/30; G01B 5/14; F04G 21/18; F04G 17/075

[52] U.S. Cl. ..... 33/526; 33/518; 52/509; 52/712; 249/214

[58] Field of Search ..... 33/526, 518, 626, 613, 33/645; 24/546, 553; 52/308, 747, 712, 98, 477, 379, 509, 562, 383, 518; 249/214

[56] References Cited

U.S. PATENT DOCUMENTS

| | | | |
|---|---|---|---|
| 1,293,391 | 2/1919 | Ewing | 249/214 |
| 1,765,464 | 6/1930 | Flath | 52/712 |
| 2,227,842 | 1/1941 | Polivka | 52/509 |
| 2,797,495 | 7/1957 | Walston | 33/518 |
| 2,930,135 | 3/1960 | Rodtz . | |
| 3,010,213 | 11/1961 | Rodtz . | |
| 3,199,205 | 8/1965 | Halde et al. | 33/526 |
| 3,290,712 | 12/1966 | Richey | 33/518 |
| 3,396,936 | 8/1968 | Bowden | 249/214 |
| 3,735,497 | 5/1973 | Boettcher . | |
| 4,054,258 | 10/1977 | Holmboe | 249/214 |
| 4,114,337 | 9/1978 | Neuhardt . | |
| 4,239,173 | 12/1980 | Sawyer | 249/214 |
| 4,277,927 | 7/1981 | Richter . | |
| 4,408,398 | 10/1983 | Glaze . | |
| 4,774,793 | 10/1988 | Mayer . | |
| 4,792,068 | 12/1988 | Golkar | 33/526 |
| 4,959,937 | 10/1990 | Mayer | 52/509 |

OTHER PUBLICATIONS

Pittsburgh Corning, "PC Glass Block Spacers" Data Sheet Nov. 1988 (Referencing U.S. Pat. No. 4,114,337).

*Primary Examiner*—Allan N. Shoap
*Assistant Examiner*—C. W. Fulton
*Attorney, Agent, or Firm*—Myers, Rose & Liniak

[57] ABSTRACT

A reusable spacer tool comprises a pair of opposed spacer members each having a plurality of ears projecting from a base portion toward the opposite member, the ears being arranged for reception in the joints between adjacent blocks to space apart edges of the blocks when the spacer members overlie opposite faces of the block at the corners, and tie means extending between the spacer members and removably secured thereto releaseably hold the members against opposite faces of the blocks.

7 Claims, 1 Drawing Sheet

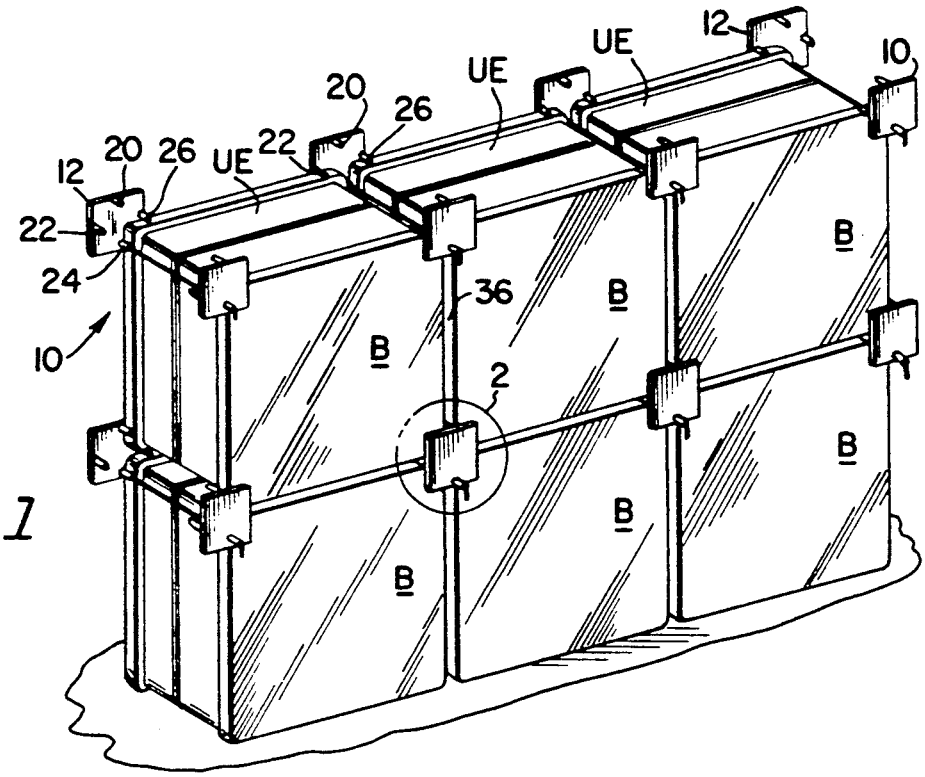
Fig. 1
Fig. 2
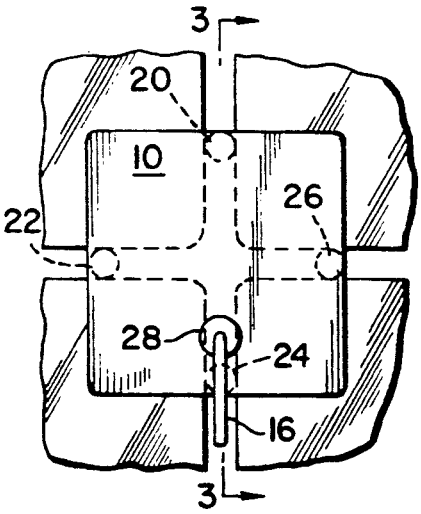
Fig. 3
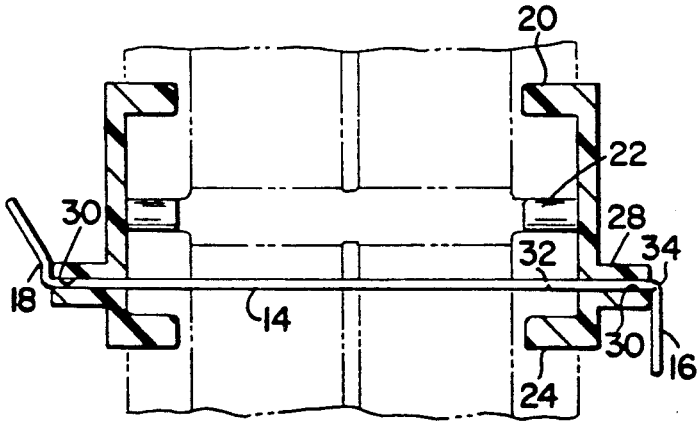
Fig. 4
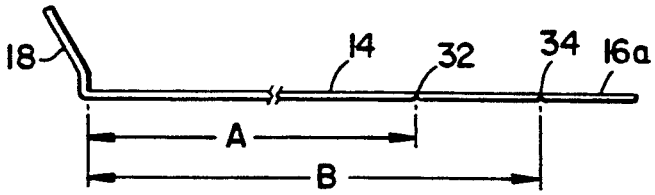
Fig. 5
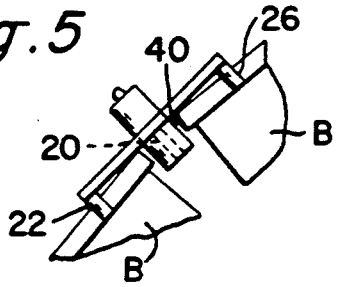

GLASS BLOCK SPACING TOOL AND METHOD

FIELD OF INVENTION

This invention relates to reusable glass block spacers and to a method of constructing glass block panels or walls utilizing the spacers.

BACKGROUND OF THE INVENTION

In the lay-up of glass block panels or walls, masons spread mortar on exposed edges of the blocks and set them in place. The spacing between the blocks, both vertically and horizontally, is generally "eye-balled" by the mason and determined by the amount of mortar spread on the edges and by tapping or lightly shifting the block when it is set in place. Such method of setting the blocks requires both a skilled mason and patient work to carefully adjust each block and is a time-consuming procedure.

As shown in the following patents, suggestions have been made to control the spacing between the blocks by the use of spacers which are disposed in the joints and hold the blocks in uniform spaced relation while the mortar sets: U.S. Pat. Nos. 4,114,337; 4,774,793. The spacers remain in place after the mortar sets. Because the spacers are consumed in the panel, not only must their cost be added to the panel cost, but their presence in the panel or wall renders it somewhat weaker then if only mortar was present. In addition, if the spacer remains in the wall, their pressure will prevent the wall from having an Underwritten Laboratory fire rating approval. In U.S. Pat. No. 4,408,398, a gauge member is shown which is removed from the mortar joint before the mortar sets up. However, such gauge will leave substantial holes in the mortar which are the diameter of the space between the blocks and would be difficult to fill.

SUMMARY OF THE INVENTION

I have disclosed herein a reusable glass block spacer assembly or glass block spacer tool which permits rapid panel or wall construction with precise uniform joints and which will work with both wall reinforcing and panel anchors. Panels constructed with my improved spacers are stronger because nothing is left in the joint. My spacers are usable with both flat and curved walls and standard and specially-shaped blocks. The reusability of the spacers provides for long term economy.

The spacers function in assemblies comprising pairs of spacers connected by a removable tie wire which extends across the joint and temporarily holds the spacers against opposite faces of the blocks. Each spacer comprises a flat base portion having four short perpendicular spacer pins or ears arranged to project between adjacent blocks to space them apart both horizontally and vertically by the diameter of the pins when the base portion overlies the face of the blocks at the corner. The tie wire, which is a thin or small diameter wire, extends through the base portions of opposite spacers and ties the pair together. As the blocks are mortared and laid in place, pairs of spacers or spacer assemblies are positioned at the corners to accurately position the blocks. Before the mortar sets, the wire is pulled out, a tab on the exposed face of the base member (acting as a handle) is grasped by the mason, and the spacers removed. The joint between the blocks is then tooled to both clean up the joint and eliminate the mortar depressions of the pins. In actual tests, masons using the spacers would consistently lay up twice as many blocks per hour as when they were not using the spacing tool.

Other advantages and meritorious features will be noted from the following detailed description of a preferred embodiment shown in the accompanying drawings.

BRIEF DESCRIPTION OF THE DRAWINGS

FIG. 1 is a perspective view of two courses of glass blocks showing the spacing tool or spacer assembly in use to space the blocks both vertically and horizontally;

FIG. 2 is a fragmentary detailed view of one of the spacers as shown at area 2 of FIG. 1;

FIG. 3 is a cross-sectional view taken on the line 3—3 of FIG. 2;

FIG. 4 is a side elevation of a typical tie wire; and

FIG. 5 is a partial top view of a sleeve mounted on a pin.

BRIEF DESCRIPTION OF PREFERRED EMBODIMENT

My glass block spacing tool is shown in use in FIG. 1. The tool comprises a spacer assembly consisting of opposed pairs of spacer members 10 and 12 releasably connected together by a thin wire tie 14 which extends through the spacer members and is bent over as at 16 and 18 to prevent the spacer members from spreading further apart. Each spacer member is of a flat generally planar configuration and in the embodiment shown, is of square profile. Four short perpendicular spacer pins or ears project from each member toward the opposite member and are disposed in equidistant relation around the periphery of the spacer. In the embodiment shown, the pins are located midway between opposite corners of the spacer.

The spacer pins are intended to enter the mortar joint between adjacent edges of the blocks to space the blocks both horizontally and vertically. As shown in FIGS. 1-3, the spacers (which are each of identical construction) have one pin 24 disposed in the vertical joint 36 between the blocks B while a pair of the pins 22 and 26 overlie the upper edges of the blocks in preparation to receive the next course of blocks thereupon. The fourth pin 20 is disposed above the course of blocks in preparation for being received between the blocks of the next course to be laid.

The wire ties are preferably provided with one end bent upwardly as at 18 and the other end straight as at 16A in FIG. 4. The wire ties extend through apertures 30 in each spacer member. With reference to FIGS. 1-3 it is seen that each aperture 30 is located in the lower half and the horizontal center of its respective spacer member 10 or 12, such that opposing apertures become co-axially aligned when wire tie 14 is located therein. As can be seen in FIG. 1 this inherently assures better stability in the assembly than if the apertures were located at or above the lower half of their respective spacer member. To assemble the spacer tool, a pair of the spacer members are arranged in confronting opposition with their spacer pins projecting toward each other and a tie wire 14 is then inserted through one of the members and then through the other and the end 16A is then bent downwardly as shown best in FIG. 3. To accommodate glass blocks of different thicknesses, and to facilitate the bending of the wires at the proper points, the wires may be provided as shown in FIG. 4 with kerfs or score marks 32 and 34. The kerf or score mark 34 would be used with glass blocks having a greater thickness while the score mark 32 would be used with thinner blocks. In one exemplary wire tie, the wire is 0.045" in diameter and the notches or kerfs are 0.010" deep. Dimension A shown in FIG. 4 is 4.115"±0.010 while dimension B is 4.848"±0.010. Not only do the kerfs 32 and 34 enable bending of the wire ties at the proper point for the thickness of the glass block at hand, but additionally the wire will readily break where the end is bent back up thus facilitating removal from the spacers without disturbing the mortar joint.

In using the tool, the mason would first lay a coating of mortar on the upper edge UE of the upper course of the glass blocks. The mortar has not been shown in FIG. 1 to facilitate clarity of presentation. After the mortar has been spread thereon, the mason will place the glass block spacer tools in the position shown in FIG. 1 by pressing the pins or spacer ears downwardly into the mortar so that the pins rest against the edges of the glass blocks. If desired, the spacers may be positioned as shown in FIG. 1 and the mortar thereafter applied. Either approach will result in the positioning of the spacers.

The next course of glass blocks is then laid over the mortar on the UE edges and the blocks are positioned to rest firmly against the spacer ears or pins to both space the blocks vertically as well as horizontally. Normally in laying this next course, mortar would be placed on one end of each block to be laid. Following laying up of the various courses, the arrangement will appear as shown in FIG. 1 with the spacer members overlying the four corners of adjacent blocks. Before the mortar has set-up, the spacer tools should be removed. This may be readily accomplished by bending the end 16 (see FIG. 3) upwardly which will normally cause it to break off at the kerf 34 and thereafter, the wire tie is withdrawn by grasping the end 18 and pulling the remaining wire out of the spacer members and through the still damp mortar. At this point, the mason grasps the bosses or projections 28 and pulls the spacer member away from the face of the block.

Conveniently, the apertures 30 extend through these projections or bosses 28 which provide a reinforced area for reception of the wire ties and insure that the plane of the spacer member is perpendicular to the axis of the wire tie as best shown in FIG. 3. Following removal of the spacers, the mason will then tool the joint to dress it and fill the small apertures left by the spacer pins or ears. Should it be desired to construct a glass block wall having a curved surface, sleeves 40, shown in FIG. 5, may be inserted over opposite pairs of the spacer pins or ears of one of the spacers of each tool so that the pins at one side will present a greater diameter than those at the opposite spacer. Accordingly, when the wall is laid up, the joint will be greater at that side where the sleeves encircle the pins, thus providing for a curved surface in the configuration of the wall. Such spacer sleeves may be used either on the pins 20 and 24 at one side of the wall to cause the wall to curve about a vertical axis, or on pins 22 and 26 to cause the wall to curve about a horizontal axis, or of course may be used on all pins at one side of each spacer tool to cause the wall to curve in a dome shape.

The spacer members are preferably formed of plastic selected to withstand the chemicals present in the mortar used for glass block wall laying.

In FIG. 1, the lower course of glass blocks is indicated at $B_1$ while the next higher course is indicated by the reference characters B.

If desired, the spacer members may be of circular configuration rather than square, though the square shape appears to function most satisfactorily.

While the best mode for carrying out the invention has been described in detail, those familiar with the art to which this invention relates will recognize various alternative designs and embodiments for practicing the invention as defined by the following claims.

What is claimed is:

1. A removable glass-block spacer tool for holding glass blocks in proper spaced alignment during construction of a panel or wall being formed of said blocks, said spacing between said blocks being substantially completely filled with mortar, said tool comprising:

a pair of opposing plate-like base members having opposite, opposing faces;

a plurality of pin-like projections extending from each said opposing face toward the other opposing face of said other plate-like base member, said pin-like projections being so arranged on each of said opposing plate-like base members so as to project into said mortar without displacing any significant portion thereof and to receive and retain opposing corner surfaces of said glass blocks, each said pin-like projection extending from one of said opposing faces having a substantially co-axially aligned corresponding pin-like projection extending from the other of said opposing faces, thereby to properly space and align said glass block with respect to each other; and means for firmly securing said spacing and alignment of said blocks which includes for each pair of said opposing plate-like base members, a cross-member means sufficiently thin so as not to displace a significant portion of said mortar and aperture means located in the lower half and horizontal center of each of said opposing faces and co-axially aligned with the other, said cross-member means being fastenable in said aperture means thereby to tightly secure said spacing and alignment of said blocks.

2. A removable glass-block spacer tool according to claim 1 wherein said cross-member means comprises a thin wire removably extending through opposing apertures and bent to overlie the spacer members and prevent separation thereof.

3. A removable glass-block spacer tool according to claim 2 wherein handle means are provided on the opposite face of the base member from the pin-like projections for removing the base member from a wall, said apertures extending through the handle means, and wherein said handle means comprises an ear-like projection.

4. A removable glass-block spacer tool according to claim 1 wherein sleeve members are provided for reception over selected pin-like projections to increase the space between adjacent edges of blocks at one spacer member.

5. The method of laying up a glass block wall comprising the steps of:

applying wet mortar to the upwardly facing edges of a first course of glass blocks;

assembling a pair of opposing flat plates with a cross-member means, said opposing flat plates being provided with a plurality of pin-like projections extending from the opposing face of each of said plates toward the other opposing face of said other plate, said pin-like projections extending from one of said opposing faces having a substantially co-axially aligned corresponding pin-like projection extending from the other of said opposing faces, each of said faces having aperture means co-axially aligned with the other and located in the lower half and horizontal center of each of said opposing faces, said pin-like projections and said cross-member means being sufficiently thin so as not to displace a significant portion of said mortar, said assembly including locating said cross-member means in said aperture means so as to extend between said opposing flat plates;

pressing said assembly into said applied wet mortar so as to locate said cross-member means in the mortar of the vertical joint between the blocks and so that two pin-like projections are pressed into the wet mortar located on the upwardly facing horizontal edges of the blocks and rest against said upwardly facing horizontal edges of the blocks, and a third pin-like projection is disposed so as to be spaced above the course for horizontally spacing apart blocks in the next course to be laid;

said cross-member means and aperture means cooperating to hold said opposing flat plates and pin-like projections in proper opposing alignment while laying a second course of blocks on the mortar-coated edges of the first said course and positioning the blocks of the second course upon said two pin-like projections to space the blocks vertically and on opposite sides of said third pin-like projection to space the blocks horizontally; and before the mortar sets, removing said assembly from the blocks and tooling the mortar joints.

6. The method according to claim 5 wherein said cross-member means comprises a thin wire removably extending through opposing apertures and wherein said method further includes the step of bending said thin wire so as to overlie the spacer members and prevent separation thereof.

7. The method according to claim 6 wherein there is further provided an elongated boss on each of the spacer members, said apertures extending therethrough, said boss being of a size and configuration so as to provide a reinforced area for reception of said thin wire, such that the plane of the spacer member is perpendicular to the axis of the wire.

* * * * *